US005318598A

United States Patent [19]

Holfeld et al.

[11] Patent Number: 5,318,598

[45] Date of Patent: Jun. 7, 1994

[54] NONAQUEOUS POLYAMIDE DYEING PROCESS UTILIZING CONTROLLED DYE ADDITION

[75] Inventors: Winfried T. Holfeld; Dale E. Mancuso, both of Wilmington, Del.

[73] Assignee: E. I. Du Pont de Nemours and Company, Wilmington, Del.

[21] Appl. No.: 68,880

[22] Filed: May 28, 1993

Related U.S. Application Data

[63] Continuation-in-part of Ser. No. 745,044, Aug. 14, 1991, Pat. No. 5,230,709, which is a continuation-in-part of Ser. No. 614,535, Nov. 15, 1990, abandoned.

[51] Int. Cl.[5] ..... D06D 5/00

[52] U.S. Cl. ..... 8/400; 8/504; 8/611; 8/924

[58] Field of Search ..... 8/400, 504, 611, 924, 8/673, 681, 685

[56] References Cited

U.S. PATENT DOCUMENTS

| | | | |
|---|---|---|---|
| 3,710,601 | 5/1971 | Blanc et al. | 68/18 C |
| 3,738,803 | 6/1973 | Blanc et al. | 8/93 |
| 3,932,127 | 1/1976 | D'Albignac | 8/173 |
| 3,966,406 | 6/1976 | Namiki et al. | 8/179 |
| 4,125,371 | 11/1978 | Beutler et al. | 8/176 |
| 4,351,076 | 9/1982 | von der Eltz et al. | 8/149.1 |
| 4,483,032 | 11/1984 | Christ et al. | 8/149.1 |
| 4,629,465 | 12/1986 | Hasler et al. | 8/400 |
| 4,820,312 | 4/1989 | von der Eltz | 8/533 |
| 4,885,814 | 12/1989 | von der Eltz et al. | 8/149.1 |

FOREIGN PATENT DOCUMENTS

| | | |
|---|---|---|
| 2624176 | 12/1983 | Fed. Rep. of Germany . |
| 2823543 | 11/1987 | Fed. Rep. of Germany . |
| 1299777 | 12/1972 | United Kingdom . |

OTHER PUBLICATIONS

E. Merian and U. Lerch, American Dyestuff Reporter, 695–702, Sep. 17, 1962.

R. McGregor, Canadian Textile Journal, 61–68, May 1973.

W. Holfeld & M. Shephard, Textile Chemist and Colorist, a reprint from vol. 10, No. 2–3, Feb. and Mar. 1978.

H. Heilweil, TRI Notes on Research, No. 414, Jul. 1988.

J. Cegarra, P. Puente, J. Valldeperas, and M. Peio, Textile Research Journal, 645–653, Nov. 1988.

*Primary Examiner*—Paul Lieberman
*Assistant Examiner*—Margaret Einsmann

[57] ABSTRACT

A process for the dyeing of a fibrous article containing fibers of a polyamide polymer with at least one anionic dye. The process includes immersing the article in a liquid dyeing bath of a substantially nonaqueous solvent medium and heating to a temperature at least equal to the dyeing transition temperature of the fiber. The anionic dye is added to the dyeing bath so that the rate of dye addition is the primary control over the rate of dye uptake by the article.

11 Claims, 1 Drawing Sheet

NONAQUEOUS POLYAMIDE DYEING PROCESS UTILIZING CONTROLLED DYE ADDITION

The present invention is a continuation-in-part of application Ser. No. 07/745,044, filed Aug. 14, 1991, now U.S. Pat. No. Ser. 5,230,709, which is a continuation-in-part of application Ser. No. 07/614,535, filed Nov. 15, 1990, now abandoned.

BACKGROUND OF THE INVENTION

The present invention relates to the dyeing of fibrous articles containing polyamide fibers with anionic dyes.

Anionic dyes such as acid dyes and pre-metallized dyes are widely used for the dyeing of polyamide fibers in which the nitrogen-containing groups of the polyamide polymer serve as dye sites. In conventional dyeing processes using such dyes, articles containing the polyamide fibers are immersed in an aqueous bath containing a solution of the dye after any pre-treatment processes such as scouring. While a wide variety of dyeing equipment is used, it is typical for all of the dye to be used in the process to be present in the bath initially. The bath containing the dye and the article to be dyed is also usually at a low initial temperature, e.g., 80°-120° F. (26.7°-48.9° C.) increased gradually to an elevated temperature often as high as the boiling point as the dyeing progresses.

While high quality dyeing can be achieved using the conventional dyeing process for some acid dyes such as small molecule "levelling" dyes, dye cycles to achieve levelling with such anionic dyes are sometimes extremely long and are therefore costly. Moreover, with large molecule acid and pre-metallized dyes which are desirable for applications requiring good light and/or wash fastness, there are often severe dye uniformity problems associated with the conventional dyeing process.

Large molecule acid and pre-metallized dyes are often referred to as "structure sensitive" dyes since non-uniform dyeing can result from even minor, and otherwise undetected, variations in the fiber physical structure. While dye-levelling and/or retarding agents can be added to the dye bath to improve dyeing uniformity, such agents sometimes provide only limited increases in dye uniformity and usually have disadvantages including increased initial expense and higher cost to treat the spent dyeing bath. In addition, because of their retarding effect, such chemical agents can sometimes increase dyeing cycles or make it difficult to obtain deep colors or dark shades. Also, dye yields from anionic dyes, i.e., the strength of color produced from a given quantity of dye on the fiber, are sometimes not as high as desired.

Conventional dyeing processes employing aqueous dyebaths typically generate large volumes of wastewater containing substantial quantities of dye and/or chemicals. Disposal of such wastewater is expensive because extensive waste treatment processes may be required before such wastewater can be discharged.

SUMMARY OF THE INVENTION

The invention provides an improved process for the dyeing of a fibrous article containing fibers of a polyamide polymer with at least one anionic dye. A process in accordance with the invention includes immersing the article in a liquid dyeing bath of a substantially nonaqueous solvent medium for the anionic dye. The substantially nonaqueous solvent medium comprises at least about 10% by volume of a water-miscible alcohol selected from the class consisting of methanol, ethanol, ethylene glycol, propylene glycol and mixtures thereof. The dyeing bath and the article in the dyeing bath are heated to a temperature at least equal to the dyeing transition temperature of the fiber of polyamide polymer. The anionic dye is added to the dyeing bath as a liquid concentrate containing a substantially non-aqueous solvent medium for the anionic dye. At least about 33% of the total dye to be applied during the process is added while the dyeing bath and the article are at a temperature at least equal to the dyeing transition temperature. The dyeing bath is stirred as the dye is added to the bath to mix the dye concentrate into the dyeing bath to form a dilute dye solution and to provide a flow of the dilute dye solution relative to the article to cause the dye to be transported to the article, the stirring further providing, on the average, essentially uniform dye transport of the anionic dye to the article. The dye is added to the bath so that the dye addition rate is the primary control over the rate of dye uptake by the article.

In one form of the invention, the anionic dye is added at an addition rate of about 0.0005 to about 0.5% dye/-minute based on the weight of the article.

In another form of the invention in which the process is performed in a dyeing machine in which the stirring provides repetitive machine cycles, the dye is added to the bath at a dye addition rate such that between about 0.04% and about 7% of the total dye to be applied during said process is added to said dyeing bath during a machine cycle.

DETAILED DESCRIPTION

Figure 1:
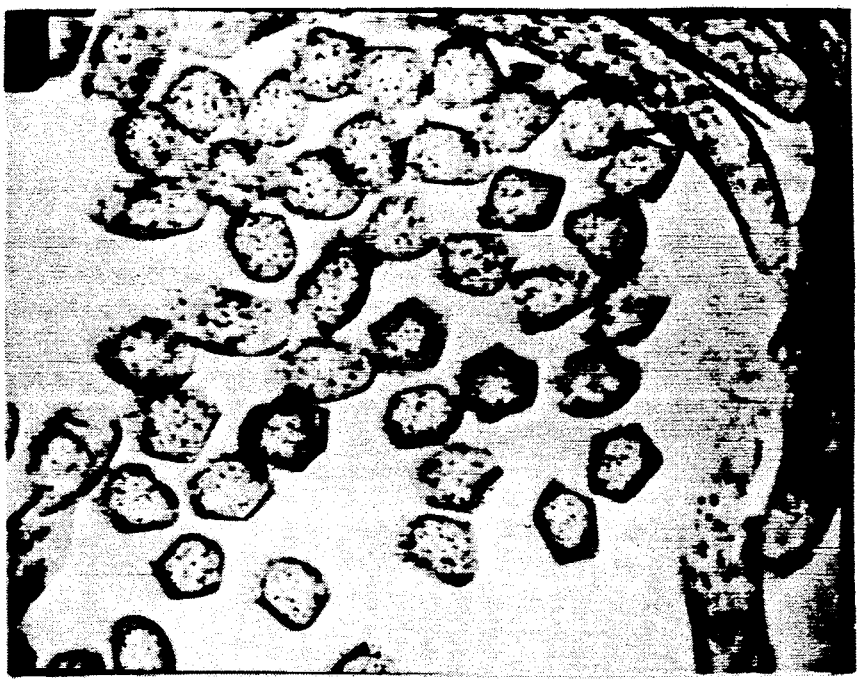
FIG. 1 is a cross-sectional photomicrograph at 400× of a yarn in a preferred dyed fabric in accordance with the invention (Example 2-Part B)

The process of the invention is useful for dyeing articles containing fibers of a variety of polyamides. The invention is particularly useful for fibers made from aliphatic polyamide homopolymers and copolymers which are melt-spinnable to form fibers which are amenable to processing for textile uses. A preferred class of such polyamides contains at least one of poly(hexamethylene adipamide) or poly(ε-caproamide) polymer units in an amount greater than about 60% by weight. A most preferred class of polyamides contains at least about 85% by weight poly(hexamethylene adipamide). In the examples which follow, homopolymer poly(hexamethylene adipamide) is referred to as 66 nylon.

There are a wide variety of fibrous articles containing polyamide fibers which can be dyed using the process of the invention including, for example, yarns, fabric, carpets and garments. Fabrics include the usual textile forms including woven, knitted, and non-woven varieties. The polyamide fiber in such articles can be present in a wide variety of forms including flat or textured continuous filaments, staple yarns, bulked continuous filaments, etc. The polyamide fiber can be present in the article together with any of a variety of other synthetic or natural fibers. Typical of such articles are staple yarns made from a "blend" of polyamide staple with other fibers and fabrics and garments made from such yarns. The invention is particularly useful with fabrics containing continuous filament polyamide yarns together with elastic fibers such as spandex sold under the trademark Lycra® by E. I. du Pont de Nemours & Company. The other fibers in such articles may or may not undergo dyeing as the polyamide fibers are dyed in the process. In addition, the polyamide fibers to be dyed may already contain the same or a different dye. For example, the process of the invention may be used for a dye "add" to get to "shade" with the fiber already containing most of the dye before the process is used.

The dyes used in the practice of the present invention are anionic dyes and dyeing of the polyamide fiber is accomplished by uptake of the dyes through the association of the dye molecules with nitrogen-containing groups on the polyamide polymer molecules. Most anionic dyes are members of the well-known class of "acid" dyes. Another type of anionic dyes is the type referred to as "pre-metallized" dyes which are the reaction products of, for example, chromium or cobalt and selected dyes. As will become apparent hereinafter, mixtures of two or more dyes are often used to achieve a desired shade. In this application, the word "dye" may be used to refer to a single dye or multiple dyes as in a mixture of dyes used in a dyeing process or on a dyed article. In processes using more than one dye such as in dye mixtures to achieve compound shades, a process is intended to be within the scope of the invention provided that at least one dye of compound shade is applied to an article in accordance with the invention.

In accordance with a preferred process in accordance with the invention, the temperature and acidity are maintained in the dye bath so that anionic dyes transfer less than about 10%. Transfer is a measure of the propensity of anionic dyes to migrate from one dye site to another after being absorbed by the fiber. Transfer (reported as % transfer) under a given set of conditions can be measured in a mock dye bath as in the transfer test method described hereinafter.

Providing transfer of less than 10% can easily be accomplished by use of dyes from a preferred class of dyes, the "structure sensitive" anionic dyes. These dyes are usually large molecule acid ("milling") dyes or pre-metallized dyes which are non-levelling, i.e., the dye molecules do not "transfer" significantly and thus migrate very little from one dye site to another after being absorbed by the fiber. Typically, structure sensitive dyes "transfer" less than 10% under normal conditions of use. "Structure sensitive" is the term applied to such dyes since non-uniform dyeing can result from even minor, and otherwise undetected, variations in the fiber physical structure. Such variations arise from the cumulative effects of thermal, mechanical, and chemical energy inputs during fiber manufacturing (including finish application) and in subsequent textile processing. Despite their known difficulties in use, structure sensitive dyes are desirable for many applications due to their washfastness, lightfastness, or both.

Without intending to limit this preferred form of the invention to these specific dyes, commonly used structure-sensitive dyes are represented, for example, by the list provided below (C.I. refers to the Color Index, 3rd edition, 1971):

Highly Structure Sensitive

C.I. Acid Green 28
C.I. Acid Blue 290
C.I. Acid Blue 264
C.I. Violet 54
Nylanthrene Blue GLF[1]
Tectilon Fast Blue RW[2]
C.I. Acid Violet 103
C.I. Acid Violet 48
C.I. Acid Blue 122
C.I. Acid Blue 280
C.I. Acid Red 182
C.I. Acid Brown 45

Moderately Structure Sensitive

C.I. Acid Orange 116
C.I. Acid Blue 230
C.I. Acid Red 114

[1]Crompton & Knowles Corp., Charlotte, N.C. 28233
[2]Ciba-Geigy Corp., Dyestuffs & Chemicals Div., Greensboro, N.C. 27419-8300

Structure sensitive (rate sensitive) dyes are discussed in more detail in Textile Chemist and Colorist, Vol. 17, No. 12, p.231 (1985).

For dyes which are normally described as "levelling" dyes since they transfer readily and "level" under the normal conditions of use, transfer of less than about 10% can be accomplished using conditions of high acidity in the solvent medium, low temperature, or both. In addition, with dyes which are normally strongly levelling, it may be necessary to perform the dyeing rapidly even though the conditions in the dyeing bath are such that the dye transfers less than about 10%. Otherwise, the dye yield benefits which are otherwise obtainable using the invention may be diminished due to dye transfer which occurs after the dye is on the article.

As in conventional dyeing processes, it is desirable to scour the article before dyeing to remove yarn finishes, sizing and other materials which may adversely affect the dyeing. In the use of the invention for dyeing warp knit fabrics, particularly for critical dye applications, it is important for the fabrics to be effectively scoured before dyeing. The fabrics can be scoured, for example, in an open width scouring range or in the apparatus to be used for the dyeing, e.g., a jet or beam dyer. Scouring solutions used conventionally are generally suitable, e.g., water at 160°-180° F. (71.1°-82.2° C.) containing a surfactant such as 0.5 gram/liter of MERPOL LFH® (a liquid non-ionic detergent sold by E.I. Du Pont de Nemours & Company, Inc. of Wilmington, DE). After scouring, the fabric should be rinsed such as by being immersed in hot water. Non-aqueous scouring processes can also be used.

As is done for known dyeing processes, it is desirable to heat-set some warp knit fabrics such as tricot before dyeing to stabilize the fabric and prevent "edge curling" which can cause unlevel dyeing. It is particularly desirable to heat-set elastic tricot fabrics since these fabric have a strong propensity to edge curl. It may be advantageous to dry and heat-set scoured fabrics in a single step such as in a pin tenter. Trimming the edges of the fabric during heat-setting may also assist in minimizing edge curling during dyeing.

In the process of the invention, the article to be dyed is immersed in a dyeing bath containing a substantially nonaqueous solvent medium for the anionic dye. The dyeing bath can take a wide variety of forms in which the article is totally immersed in the bath throughout the dyeing process or is partially immersed at any one time and is moved in a cyclical or random fashion to provide contact for the entire article with the solvent medium. Partial immersion is useful for articles such as fabrics where the fabric can be progressively advanced through the bath, either in continuous rope form or by reciprocation of an article having a discrete length, so that the entire article is ultimately dyed.

A process in accordance with the invention is advantageously carried out on fabrics in dyeing apparatus which are suitable for non-aqueous solvents such as a beam dyer modified to provide for handling of the non-aqueous solvent medium and which includes the capability for recovery of the solvent medium, usually by distillation.

The substantially nonaqueous solvent medium for the dye comprises at least about 10% by volume of a water-miscible alcohol selected from the class consisting of methanol, ethanol, ethylene glycol, propylene glycol and mixtures thereof. Preferably, the solvent medium comprises at least about 90% by volume of one or a mixture of these water-miscible alcohols. A particularly preferred embodiment of the invention employs a bath of 100% methanol containing only the chemical additives necessary or desirable for dyeing.

By "substantially nonaqueous" is meant that the solvent medium contains less than about 10% water by volume. With ethanol, for example, it is difficult to entirely eliminate water if the solvent medium is recycled by distillation since ethanol forms an azeotrope at a ratio of ethanol to water of about 95/5. At least some of the water typically held in the polyamide fiber will likely be introduced into the bath during dyeing.

The remainder of the substantially nonaqueous solvent medium for the dye can be any of a variety of nonaqueous liquids provided they are otherwise compatible with the fabric, dye and other aspects of the process. These nonaqueous liquids may function as a solvents for the dye. Alternately, the dye may only be insoluble or only slightly soluble in these liquids which will then act merely as diluents for the water-miscible alcohol or other solvents if other dye solvents are present. Preferably, all of the non-aqueous liquids of the solvent medium are miscible with each other and with the water-miscible alcohols so that a one-phase dyeing bath is provided.

Similar to a process for dyeing polyamides in an aqueous dyebath, it is generally necessary for the bath to be acidic. Typically, acid dyes are available commercially as sodium or potassium salts and the dyebath must be sufficiently acidic that they are effectively absorbed by the polyamide fiber. Suitable acids to provide acidity in the dyebath include organic acids such as acetic acid or formic acid. In the preferred form of the invention where temperature and acidity of the dyeing bath are maintained so that anionic dye transfers less than about 10%, increased quantities of acid may be required to achieve the desired low level of transfer if levelling dyes are used.

Other additives to the dyebath can be chemicals such as levelling agents, retarders, and the like which are referred to collectively in the present application as "dyeing auxiliaries". Dyeing auxiliaries can be present in the process of the invention although such agents often are not needed. If dyeing auxiliaries are present in the bath, a much lower concentration is typically used to keep the dye cycle to a reasonably short duration. Dyeing auxiliaries can be useful and may be desirable for compound shades of dyes of differing affinities.

When the bath has low levels of or is substantially free of dyeing auxiliaries, significant advantages are obtained in recycling of the spent solvent medium. Moreover, the dyed fiber may be substantially free of residual dyeing auxiliaries or such agents may be present only at much lower levels than in fibers dyed by the conventional process for structure sensitive dyes which typically require high bath concentrations of dyeing auxiliaries. In addition, it is possible in some instances to use the spent dyeing bath for after-treatments such as for improving wetfastness, lightfastness or softness, applying antistats, and for other known after-treatments employing chemical agents. For such after treatments, the chemical agent can be added to the hot bath using a technique similar to that used to add the dye in a process in accordance with the invention. In addition, it is also possible to reuse the spent bath without employing solvent medium recovery in a subsequent dyeing if dyeing auxiliaries are absent or are present in sufficiently low concentration.

The anionic dye is added to the dyeing bath as a liquid concentrate at a controlled dye addition rate during a dye addition period. "Dye addition period" refers to the time period beginning with the first addition of dye and ending with the final amount of dye being added. The length of the dye addition period will usually range between about 5 minutes and about 4 hours with typical dye addition periods being between about 20 and about 100 minutes. Upon stirring as will be explained in more detail, the liquid dye concentrate is mixed with the solvent medium in the bath to form a dilute dye solution.

"Liquid concentrate" is intended to refer to a solution in which the dye is fully dissolved and which can be added to and mixed with the liquid solvent medium in the bath to form a dilute substantially nonaqueous liquid solution of the dye. Preferably, the liquid concentrate is miscible with the solvent in all proportions of such concentrates which would normally be mixed into a dye bath so that a one-phase dilute dye solution is provided in the bath. The solvent medium for the liquid concentrate can be different than the liquid solvent medium provided that the introduction of a different solvent medium does not otherwise adversely affect the dyeing process. Because of the higher concentration of the dye in the liquid concentrate, it may be desirable for the solvent medium of the concentrate to be a more effective solvent for the dye than the bath medium.

As will be explained in more detail hereinafter, the dye addition rate is adjusted depending on the amount of dye to be applied, the characteristics of the article to be dyed, the type of dyeing apparatus, the type of dye and the conditions of the dyeing to achieve the desired results. Preferably, to facilitate control over the process and make the process more easily reproducible, the dye is added continuously and at a constant rate during the dye addition period.

In processes in which the dilute dye solution in the bath is circulated by means of a circulation pump, the liquid dye concentrate is preferably added to the solvent medium ahead of the circulation pump. A metering pump is advantageously utilized for this purpose. Preferably, when dyeing fabric in a jet dyer, the circulation pump supplies the dilute dye solution to the jet nozzle so that the newly-added dye contacts the fabric first in the jet.

In a process in accordance with the invention, the dye bath containing the solvent medium and the article in the dyeing bath are heated to a temperature at least equal to the dyeing transition temperature. For the purposes of this application, dyeing transition temperature refers to the temperature during dyeing with a particular dye at which the fiber structure opens up sufficiently to allow a marked increase in the rate of dye uptake. The dyeing transition temperature for a dye/-fiber/solvent medium combination may be determined by running a dyeing under the conditions to be used in dyeing and plotting % dye exhaust with respect to dye bath temperature when increased at 3° C./min. The temperature at 15% exhaust is the dyeing transition temperature. If more than one dye is to be used in a dyeing process, the temperature in the dyeing process is preferably at least equal to the dyeing transition temperature of the dye having the highest dyeing transition temperature (usually also the most structure sensitive). In the preferred form of the invention using jet dyeing apparatus, heating can be achieved using a heat exchanger through which liquid from the bath is circulated externally.

In a process in accordance with the invention, at least a portion of the dye is added while the solvent medium and the article are at a temperature at least equal to the dyeing transition temperature. This part of the dyeing process can be referred to as the "rapid dye uptake phase", i.e., the time period where there is dye in the bath and the solvent medium and article are at a temperature at least equal to the dyeing transition temperature. In a process where no dye is added to the bath until the solvent medium and article are at least equal to the dyeing transition temperature, the rapid dye uptake phase will begin when dye is first added to the bath. In a process where dye addition is begun before the bath is up to temperature, the rapid dye uptake phase will begin when the solvent medium and article reach a temperature at least equal to the dyeing transition temperature. In typical processes, the rapid dye uptake phase will end when the bath is exhausted toward or at the end of the dyeing process.

During the rapid dye uptake phase in one preferred process in accordance with the invention, the temperature of the bath and the article in the bath is maintained generally constant so that the dyeing process is not affected by temperature changes which may affect the rate of dye uptake by the article. Generally, provided that the temperature remains above the dyeing transition temperature, the temperature should be controlled to within ±10° C., preferably ±5° C.

In some processes, particularly processes using a dye mixture where one dye is structure sensitive and the other is strongly levelling, it may be desirable to increase the acidity and/or lower the temperature as the dyeing progresses to promote the exhaustion of the levelling dye from the bath. This is usually desirable towards or at the end of the dyeing since the structure sensitive dye may strike too fast and cause an unlevel dyeing if the initial acidity is too high or the initial temperature is too low. Increasing the acidity can be done by metering a suitable acid solution such as acetic acid into the bath after the dye addition period. Acid can also be metered into the bath together with the addition of dye.

In a process of the invention, at least about 33% of the dye is added to the bath when the solvent medium and the article are at least equal to the dyeing transition temperature, i.e., during the rapid dye uptake phase. Preferably, at least about 50% of the dye is added during the rapid dye uptake phase. Increasing dye yield benefits will be obtained with increases in the amount of dye added during the rapid dye uptake phase. However, it may be desirable to forgo some of the dye yield increase to take advantage of decreased cycle time which may be obtained by adding at least some of the dye into the bath before it is up to the dyeing transition temperature.

Stirring of the bath during the dye addition period and the rapid dye uptake phase is done to mix the dye concentrate with the solvent medium in the bath to form a dilute dye solution and to provide a flow of the dilute dye solution relative to the article to cause the dye to be transported to the article. The term "stirring" is intended to include any means of mixing and imparting relative motion between the article and the solvent medium in the dyeing bath. The relative motion between the article and the solvent medium can be imparted by circulating the solvent medium in the dye bath, moving the article in the solvent medium, or both moving the article and circulating the liquid. In a process employing a jet-dyeing apparatus, both the article is moved and the bath liquid is circulated by action of circulating liquid with the fabric circulation being usually assisted by a rotating reel usually provided in such equipment.

The stirring also provides, on the average, essentially uniform dye transport of the anionic dye to the article during the dye addition period and rapid dye uptake phase so that a dyeing results which is sufficiently visually level to be useful for the intended purpose. Typically, a visually level fabric has shade variations across the fabric which are less than about 5%. Thus, during a process in which there are a number of repetitive cycles as when the invention is practiced in a jet dyer where the fabric rope cycles numerous times through the jet nozzle, the dye transport to the fabric may not be uniform in any one machine cycle. However, the additive effect of dye transport during all of the cycles is such that a level dyeing results since dye transport "on the average" is essentially uniform. As will become more apparent hereinafter, it may be desirable to increase the turnover rate, limit the dye addition rate, or both to decrease the percentage of total dye added per cycle and thereby increase uniformity due to the greater averaging effect obtained. To facilitate control over the process and to enable a process to be repeated, it is preferable for stirring to be performed constantly and at a constant rate.

In accordance with the invention, the dye addition rate is adjusted to be the primary control over the rate of dye uptake by the article at least while the solvent medium and the article are at or above the dyeing transition temperature. The type of adjustment of the dye addition rate necessary to accomplish this may be better understood by reference to Equation I which takes into account factors impacting the dyeing process:

$$L = \frac{D_s}{K \cdot D_f} \times \frac{r}{\delta} \qquad \text{I}$$

In Equation I, Ds is the diffusion coefficient of the dye in solution, DF is the diffusion coefficient of the dye in the fiber, K is the equilibrium distribution coefficient for the dye-fiber system, r is the radius of the fiber, and $\delta$ is thickness of the diffusional boundary layer. In a process in accordance with the invention, it has been discovered that adjusting the rate of dye addition into the bath and coordinating the rate with other conditions in the bath so that the rate of dye addition is the primary control over the rate of dye uptake provides low values for L in Equation I. It has further been discovered that the maximum benefits of the invention result when L is very low, preferably approaching zero.

To cause the rate of dye addition to be the primary control over the rate of dye uptake and thereby provide low L values, the rate of dye addition is limited so that the fibrous article, which is readily capable of accepting dye since it is above the dyeing transition temperature, is capable of accepting more dye than is supplied to it. Under these conditions, the concentration of dye in the bath is very much lower than in a conventional process and the influence of the diffusion coefficient in the fiber, Df, is therefore substantially less significant than in a conventional process. Also, the value for $Ds/(K.D_f)$ will be smaller than in a conventional process and will lead to lower L values, primarily because the value for K will increase as the concentration of dye in the dye bath decreases. This effect is particularly pronounced in the preferred form of the invention where dyes are used and/or conditions established so that the dyes transfer less than about 10%. In such cases, the value for K is very high and is further increased by the limited concentration of dye in the bath.

Rates of dye addition in the process in accordance with one form of the invention based on the fabric weight are about 0.0005 to 0.5% dye/minute. The rates at the lower end of the range are useful for low percent dye-on-fiber dyeings with extremely high affinity dyes to provide a sufficient number of machine cycles for adequate averaging to provide essentially uniform dye transport.

In another form of the invention as in commercial processes employing a number of repetitive machine cycles, e.g., turnovers of the rope in a jet or beck dyer or circulation of the bath in a beam dyer, it is preferable to adjust the rate of dye addition so that an amount of dye between about 0.04% and about 7% of the total dye is added in a machine cycle to achieve, on the average, essentially uniform dye transport and a visually level dyeing in accordance with the invention. Most preferably, an amount of dye between about 0.5% and about 3% is added during a machine cycle. Using laboratory jet and beck dyeing equipment, percentages of total dye per cycle are typically lower since laboratory equipment usually has a high turnover rate which would not be practical for use in large commercial dyeing equipment although excellent results are obtained.

Using the preferred process of the invention in which conditions are used so that the dyes transfer less than 10% in the same equipment used for conventional polyamide dyeings, articles containing dyed polyamide fiber can be produced with a higher relative dye strength for the same relative dye content, i.e., to have a higher relative dye yield, than can be obtained using conventional processes. Depending on the type of dye being used, the temperature and acidity in the dyebath can be used to adjust the relative dye yields obtained for a process of the invention. For example, with most anionic dyes, increasing the acidity will provide increases in relative dye yields. For dyes which level under conventional conditions, it may be desirable to employ lower temperatures which has the primary effect of decreasing transfer. With increased temperatures above the dye transition temperature, relative dye yields provided by many structure sensitive dyes may increase. However, in general, conditions which produce the maximum benefits in terms of dye yield with structure sensitive dyes may make it more difficult to obtain a visually level dyeing. Accordingly, it may be necessary to select conditions which provide a compromise between relative dye yield increases and still provide a level dyeing without extraordinary care.

The preferred process of the invention using dyes under conditions such that the transfer is less than 10% is capable of minimizing the sensitivity to structural differences in the fibers which can lead to non-uniform dyeing. Provided that the transport of the dye to the article is, on the average, essentially uniform, a visually level dyeing will result which can cover streaks in a fabric due to structural differences in the yarns and produce dyed fabric with a higher uniformity rating than is produced using a conventional process.

It is also possible to adjust the results of the invention by including dyeing auxiliaries in the solvent medium in the dye bath or including them in the dye concentrate. In general, auxiliaries which decrease the strike rate of the dye will decrease the relative dye yield obtained and the dyeing will be more like a conventional dyeing. In addition, where the dye is added into the bath before the bath has reached its dyeing transition temperature, the dye which is absorbed by the fiber before the dyeing transition temperature is reached will impart some conventional dyeing characteristics to the fiber in the article.

For setting up a commercial process, it is advantageous for the process to be run first in laboratory scale equipment corresponding generally to the chosen process conditions. In the laboratory scale process, a dye addition rate can thereby be determined in advance or a rate based on past experience for the same or similar dyeings can be confirmed. Due to smaller ratios of the weight of the bath to the weight of the goods and particularly the lower turnover rates in larger scale dyers compared to typical laboratory dyers, the dye addition rate or conditions used may have to be further modified for successful larger scale dyeings.

In the preferred form of the invention, it is usually only necessary to carefully control the process during the rapid dye uptake phase and, at most other times during the process, temperature and other bath conditions need not be as carefully controlled. For example, elevating the bath to the desired temperature can be done quickly and acidity adjustment prior to dye addition can be done expeditiously and without the degree of care required in the conventional process for dyeing nylon. This is particularly advantageous since, with only one critical stage and when constant temperature and acidity are employed, the procedure will be easily reproducible and it will be possible to efficiently make repetitive dyeings of the same fabric.

Moreover, in the event that it is discovered early in a dyeing process that the conditions in the bath are not as desired, the dye addition can be stopped and the desired conditions established before the dyeing is resumed.

After the dyeing is complete, the dyeing bath is cooled if necessary, and the solvent medium is typically transferred to vessel for recovery. The article can be rinsed, dried and subsequently used in a conventional manner. When methanol is used as the solvent medium in an appropriately equipped beam dyer, drying can be done in the dyer by heating and the methanol appropriately recovered.

The use of a substantially non-aqueous solvent medium facilitates recovery of the solvent such as by distillation. Excess dyestuff and dyeing auxiliaries are recovered as solids for re-use or for waste disposal in a solid, low volume form. Effluent treatment or disposal problems inherent in conventional aqueous dyeing systems are minimized or substantially eliminated.

Figure 2:
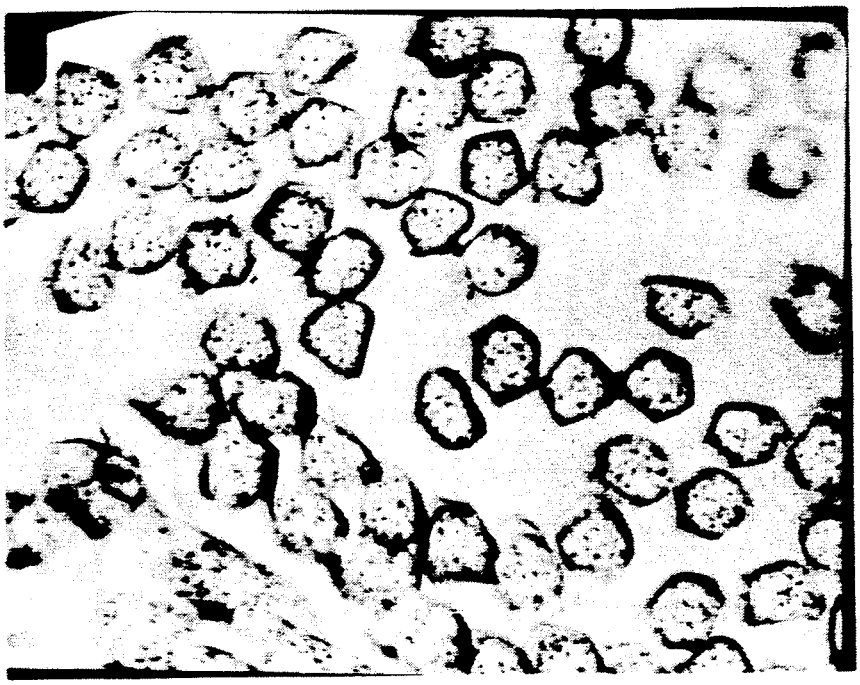
FIG. 2 is a cross-sectional photomicrograph at 400× of a yarn from the same type of fabric as FIG. 1 but dyed in a conventional manner (Example 2-Part A-Comparative)

When fabrics containing polyamide fibers are dyed using a preferred form of the invention in which temperature and acidity are selected so that the anionic dye transfers less than 10%, a fabric with a novel dye distribution can be produced. For the purposes of describing the dye distribution, the fabric has front and back fabric surfaces and a fabric interior and comprised yarns each having outside fibers adjacent to a yarn outside surface and inside fibers in a yarn interior. As may be seen in FIG. 1 which is a cross-sectional photomicrograph at 400× of a yarn in a the dyed fabric for Example 2, Part B, the anionic dye is distributed such that the outside fibers contain more dye than do the inside fibers. It will be understood that in continuous filament yarns, the same filaments may exhibit different dyeing effects along the length of the yarn since the filaments may be in different positions in the yarn bundle. This is in contrast to a fabric dyed conventionally as shown in FIG. 2 in which the dye is distributed more evenly throughout the yarn bundle with little difference between surface and interior filaments.

Despite the asymmetric dyeing of the yarns and filaments, fabrics made in accordance with the invention are visually level and are highly uniform. Moreover, the uniformity is often better than fabrics dyed conventionally, particularly with structure sensitive dyes. Often, streaks which appear in a fabric dyed conventionally due to non-uniformity in the yarn can be reduced or substantially eliminated in a dyed fabric in accordance with the invention. In the most preferred dyed fabrics in accordance with the invention, the fabrics are essentially free of end-to-end dye non-uniformities. In addition, the fabrics are equivalent to conventional fabrics in lightfastness, washfastness and in abrasion tests such as the Stoll abrasion test.

Although the invention is applicable to other types of fabrics such as non-wovens and tufted fabrics used for carpeting, preferred fabrics in accordance with the invention are selected from the class consisting of knitted and woven fabrics, most preferably those made using continuous filament yarns since dyed fabrics of this type with high uniformity ratings are often difficult to achieve.

TEST METHODS

The Dyeing Transition Temperature is determined for a fiber/dye combination as follows:

A sample of the article is prescoured in a bath containing 800 g water/g of sample with 0.5 g/l of tetrasodiumpyrophosphate and 0.5 g/l of MERPOL HCS® (a liquid non-ionic detergent sold by E.I. du Pont de Nemours & Company). The bath temperature is raised at a rate of about 3° C./min. until the bath temperature is 60° C. The temperature is held for 15 minutes at 60° C., then the fiber is rinsed and dried. (Note that the prescour temperature and the temperature during drying must not exceed the dyeing transition temperature of the fiber. If the dye transition temperature or drying temperature appear to be close to the prescour temperature, the procedure should be repeated at a lower prescour temperature.)

A approximately 800 g dyeing bath of the nonaqueous solvent medium to be used in the process under consideration is set (without the article) and a sample of the article is obtained which will provide a liquor ratio of about 20–50. The nonaqueous solvent medium is adjusted to 30° C. and 1% (based on the weight of the article) of the dye to be used in the process is added. Acid of the same type and percentage to be used in the dyeing process is also added. (If more than one dye is to be used in the dyeing process, the dye believed to have the highest Dyeing Transition Temperature should be used to determine Dyeing Transition Temperature. Usually, this dye will also be the most structure sensitive.) The article is added and the bath temperature is increased to within 5° C. of the boiling point of the bath at a rate of 3° C./min.

With every 5° C. rise in bath temperature a dye liquor sample of ~25 ml is taken from the dye bath. The samples are cooled to room temperature and the absorbance of each sample at a wavelength known to be useful for monitoring the dye is measured on a spectrophotometer such as a Perkin-Elmer C552-000 UV-visible spectrophotometer (Perkin-Elmer Instruments, Norwalk, Conn. 06856) using a reference of the solvent medium containing no dye.

The % dye exhaust is calculated and plotted with respect to dyebath temperature. The temperature at 15% exhaust is the dyeing transition temperature.

% Transfer can be determined using the AATCC Test Method 159-1989 (AATCC Technical Manual/1991, p. 285–286) except with the mock dyebath at the temperature and containing the same type and percentage of acid of the process under consideration and a 30 minute time period is used. Percent transfer is calculated in this method by measuring the relative dye strength of the original dyed sample before (control, 100% relative dye strength) and after the transfer procedure. The difference is the % transfer.

Relative Dye Strength is a relative measure of the strength of dye in a fabric determined photometrically for a series of fabrics dyed with the same dye with the sample dyed by the comparative or control procedure being arbitrarily designated as having 100% relative dye strength.

Relative dye strength for a fabric sample is measured at the wavelength of minimum reflectance using a MACBETH COLOR EYE 1500 PLUS SYSTEM Spectrophotometer, sold by Macbeth Division of Kollmorgen Instrument Corp. of Newburg, N.Y. A scan from 750 to 350 nm can be performed to determine the wavelength of minimum reflectance for the dye. All subsequent samples in a series with the same dye are then measured at the same wavelength. For example, the wavelength of minimum reflectance for C.I. Acid Blue 122 is 640 nm.

The sample produced by the comparative or control procedure is designated the control and assigned a relative dye strength of 100%. The remaining samples are then scaled in relative dye strength by the following:

$$\text{Rel. Dye Strength (\%)} = \frac{K/S \text{ sample}}{K/S \text{ control}} \times 100,$$

and $$K/S = \frac{(1-R)^2}{2R}$$

where: R = reflectance.

Relative Dye Content is a relative measure of dye content determined photometrically for a series of fabrics dyed with the same dye with the sample dyed by the comparative or control procedure being arbitrarily designated as having a 100% relative dye content.

The relative dye content is determined in the following way. First, a sample of the article is cut into small segments and about 0.1 gram is weighed to ±0.1 mg accuracy. Typically, a test series of samples of dyed articles is weighed to each have very nearly the same weights. The samples are dissolved in 30 ml of formic acid at ambient temperature. After sample dissolution is complete, centrifugation for 20 minutes is effective for removing titanium dioxide delusterant when present.

A Perkin-Elmer C552-000 UV-visible spectrophotometer (Perkin-Elmer Instruments, Norwalk, Conn. 06856) is used to record the absorbance of the samples. A scan from 750 to 350 nm is performed and the largest peaks are chosen as analytical wavelengths for the dye tested. All subsequent samples in a series with the same dye are then measured at these wavelengths. Typically, sample sizes around 0.1 gram give absorbance readings in the range of 0.3 AU to 0.8 AU for the dye levels obtained.

A corrected absorbance is calculated for each wavelength measured on every sample in the series. The corrected absorbance is:

$$A\ (\text{corrected}) = (S \times 0.1\ \text{gram})/W$$

where:

S=absorbance at a given wavelength; and

W=weight of sample in grams

The sample dyed by the comparative or control procedure is assigned a relative dye content of 100%. The remaining samples are then scaled in relative dye content by the following:

$$\text{Rel. Dye Content}\ (\%) = (A_s \times 100)/A_1$$

where:

$A_s$=average absorbance of sample; and $A_1$=average absorbance of the control sample.

This calculation is performed for every analytical wavelength chosen in a given dye series.

Yarn Cross-sectional Micrographs

Fabric swatches, or yarn bundles, are embedded in "Marglas", or a similar epoxy resin designed for microtomy. Approximately ten micron thick sections are made using a steel microtome knife. These sections are cut in a direction which will enable examining cross sections of fibers at various depths into the fabric. The sections are placed on a microscope slide and immersed in a refractive index liquid which matches, and therefore renders invisible, the epoxy embedding material. Magnifications of 100× to 500×, using objective lenses of 10× to 40× are convenient and useful for assessing distributions of dye within the filaments, within the yarn bundles and through the fabric thickness.

Relative Dye Yield is defined as the ratio of the Relative Dye Strength to the Relative Dye Content:

$$\text{Rel. Dye Yield} = \frac{\text{Relative Dye Strength}}{\text{Relative Dye Content}}$$

The invention is illustrated in the following examples which are not intended to be limiting. Percentages are by weight unless otherwise indicated.

EXAMPLE 1

Part A—Comparative

A 15 gram, 3½"×32" (8.89×81.28 cm) strip of an autoclave heat-set, Swiss pique fabric knit from false-twist-textured 70-17 nylon 66 yarns is wound on a sample tube from a Zeltex "TURBY" laboratory dyer manufactured by Zeltex AG, Basel, Switzerland. The sample is placed in a "TURBY" stainless steel dyeing beaker which contains 260 ml of methanol and 0.15 grams (1% based on the weight of the fabric) of a 10% by volume acetic acid solution in water. The "TURBY" beaker is immersed in a water bath heated to 80° F. (26.7° C.) on a "THERMIX" hot plate, supplied by Fisher Scientific Co. This is equipped with a magnetic stirrer which drives an impeller in the "TURBY" beaker to provide stirring of the liquor in the beaker.

Separately, 0.15 grams (1% based on the weight of the fabric) of Anthraquinone Blue BL (C.I. Acid Blue 122) is dissolved in 50 ml of methanol. The methanol solution of C.I. Acid Blue 122 is added into the beaker. After running the stirrer for five minutes, the temperature is raised 3° F./minute (1.7° C./minute) to 160° F.(71° C.). The procedure is carried out in a chemical hood to ensure safety.

After the bath has been up to temperature for 30 minutes, the beaker is cooled to 140° F. (60° C.), the fabric is removed, rinsed and dried. A blue dyeing is obtained.

Part B—Invention

The same procedures are used as in part A except that the stainless steel beaker is heated to 160° F. (71° C.) in the water bath before the dye is added. The dye concentrate in methanol is metered over 30 minutes into the beaker with a peristaltic pump supplied by Zeltex AG while the beaker is maintained at 160° F. (71° C.). The rate of dye addition is 0.033% dye/minute based on the weight of fabric. The dyeing is continued for 5 minutes after all of the dye is added.

A blue dyeing is obtained which has a relative dye strength which is 50% higher than the fabric resulting from Part A.

EXAMPLE 2

Part A—Comparative

A 15 gram, 3½"×32" (8.89×81.28 cm) strip of an autoclave heat-set, Swiss pique fabric knit from false-twist textured 70-17 nylon 66 yarns is wound on a sample tube from a Zeltex "TURBY" laboratory dyer manufactured by Zeltex AG, Basel, Switzerland. The sample is placed in a "TURBY" stainless steel dyeing beaker which contains 200 ml of methanol and 0.075 grams (0.5% based on the weight of the fabric) of a 10% by volume acetic acid solution in water. The "TURBY" beaker is immersed in a water bath heated to 80° F. (26.7° C.) on a "THERMIX" hot plate, supplied by Fisher Scientific Co. This is equipped with a magnetic stirrer which drives an impeller in the "TURBY" beaker to provide stirring of the liquor in the beaker.

Separately, 0.15 grams (1% based on the weight of the fabric) of Isolan Navy Blue SRL (C.I. Acid Blue 335) is dissolved in 25 ml of methanol. The methanol solution of C.I. Acid Blue 335 is added into the beaker.

After running the stirrer for five minutes, the temperature is raised 3° F./minute (1.7° C./minute) to 155° F.(68° C.). The procedure is carried out in a chemical hood to ensure safety.

After the bath has been up to temperature for 30 minutes, the beaker is cooled to 140° F. (60° C.), the fabric is removed, rinsed and dried. A navy blue dyeing is obtained. FIG. 2 is a photomicrograph of the cross-section of this fabric.

Part B—Invention

The same procedures are used as in part A except that the stainless steel beaker is heated to 155° F. (68° C.) in the water bath before the dye is added. The dye concentrate in methanol is metered over 30 minutes into the beaker with a peristaltic pump supplied by Zeltex AG, while the beaker is maintained at 155° F. (68° C.). The rate of dye addition is 0.0167% dye/minute based on the weight of fabric. The dyeing is continued for 5 minutes after all of the dye is added.

A navy blue dyeing is obtained which has a relative dye strength which is 15% higher than the fabric resulting from Part A. FIG. 1 is a photomicrograph of the cross-section of this fabric.

What is claimed is:

1. A process for dyeing a fibrous article containing fibers of a polyamide polymer with at least one anionic dye comprising:

immersing said article in a liquid dyeing bath of a substantially nonaqueous solvent medium, said substantially nonaqueous solvent medium comprising at least about 10% by volume of a water-miscible alcohol selected from the group consisting of methanol, ethanol, ethylene glycol, propylene glycol and mixtures thereof;

heating said dyeing bath and said article in said dyeing bath to a temperature at least equal to the dyeing transition temperature of said fiber of polyamide polymer;

adding said anionic dye to said dyeing bath as a liquid concentrate, said liquid concentrate containing a substantially non-aqueous solvent medium for said anionic dye, at least about 33% of the total dye to be applied during said process being added while said dyeing bath and said article are at a temperature at least equal to said dyeing transition temperature; and stirring said dyeing bath as said dye is added to said bath to mix said dye concentrate into said dyeing bath to form a dilute dye solution and to provide a flow of said dilute dye solution relative to said article to cause said dye to be transported to said article, said stirring further providing, on the average, essentially uniform dye transport of said anionic dye to said article;

said anionic dye being added at an addition rate of about 0.0005 to about 0.5% dye/minute based on the weight of said article.

2. The process of claim 1 further comprising maintaining the temperature and acidity of said dyeing bath so that said anionic dye transfers less than about 10%.

3. The process of claim 1 wherein said substantially nonaqueous solvent medium comprises at least about 90% by volume of said water-miscible alcohol.

4. The process of claim 1 wherein at least about 50% of said total dye to be applied during said process is added while said dyeing bath and said article are at a temperature at least equal to said dyeing transition temperature.

5. The process of claim 1 wherein said polyamide polymer is selected from the group consisting of aliphatic polyamide homopolymers and copolymers.

6. The process of claim 5 wherein said aliphatic polyamide is selected from the group consisting of aliphatic polyamides containing at least one of poly(hexamethylene adipamide) or poly(ε-caproamide) polymer units in an amount greater than about 60% by weight.

7. The process of claim 1 wherein said solvent mediums of said bath and of said concentrate are selected to provide a one-phase dilute dye solution in said bath.

8. A process for dyeing a fibrous article containing fibers of a polyamide polymer with at least one anionic dye comprising:

immersing said article in a liquid dyeing bath of a substantially nonaqueous solvent medium for said anionic dye, said substantially nonaqueous solvent medium comprising at least about 10% by volume of a water-miscible alcohol selected from the class consisting of methanol, ethanol, ethylene glycol, propylene glycol and mixtures thereof;

heating said dyeing bath and said article in said dyeing bath to a temperature at least equal to the dyeing transition temperature of said fiber of polyamide polymer;

adding said anionic dye to said dyeing bath as a liquid concentrate, said liquid concentrate containing a substantially non-aqueous solvent medium for said anionic dye, at least about 33% of the total dye to be applied during said process being added while said dyeing bath and said article are at a temperature at least equal to said dyeing transition temperature; and stirring said dyeing bath as said dye is added to said bath to mix said dye concentrate into said dyeing bath to form a dilute dye solution and to provide a flow of said dilute dye solution relative to said article to cause said dye to be transported to said article, said stirring further providing, on the average, essentially uniform dye transport of said anionic dye to said article;

said process being performed in a dyeing machine in which said stirring provides repetitive machine cycles;

said dye being added to the bath at a dye addition rate such that between about 0.04% and about 7% of the total dye to be applied during said process is added to said dyeing bath during a machine cycle.

9. The process of claim 8 wherein said dye addition rate is adjusted so that an amount of dye between about 0.5% and 3% of the total dye to be applied during said process is added to said dyeing bath during a machine cycle.

10. The process of claim 8 further comprising maintaining the temperature and acidity of said dyeing bath so that said anionic dye transfers less than about 10%.

11. The process of claim 8 wherein said solvent mediums of said bath and of said dye concentrate are selected to provide a one-phase dilute dye solution in said bath.

* * * * *